US009196240B2

(12) United States Patent
Kaszczuk et al.

(10) Patent No.: US 9,196,240 B2
(45) Date of Patent: Nov. 24, 2015

(54) AUTOMATED TEXT TO SPEECH VOICE DEVELOPMENT

(71) Applicant: IVONA Software Sp. z.o.o., Gydnia (PL)

(72) Inventors: Michal T. Kaszczuk, Gdansk (PL); Lukasz M. Osowski, Gdynia (PL)

(73) Assignee: IVONA Software Sp. z.o.o., Seattle, WA (US)

( * ) Notice: Subject to any disclaimer, the term of this patent is extended or adjusted under 35 U.S.C. 154(b) by 400 days.

(21) Appl. No.: 13/720,925

(22) Filed: Dec. 19, 2012

(65) Prior Publication Data

US 2014/0122081 A1 May 1, 2014

(30) Foreign Application Priority Data

Oct. 26, 2012 (PL) ..... 401371

(51) Int. Cl.

| | |
|---|---|
| ***G10L 13/00*** | (2006.01) |
| ***G10L 21/00*** | (2013.01) |
| ***G10L 13/08*** | (2013.01) |
| *G10L 13/033* | (2013.01) |

(52) U.S. Cl.

CPC ..... *G10L 13/08* (2013.01); *G10L 13/033* (2013.01)

(58) Field of Classification Search

CPC ... G10L 15/22; G10L 17/22; G10L 2015/223; G10L 13/00; G10L 15/26; G10L 13/027; G10L 13/02; G10L 13/043; G10L 15/08; G10L 13/033; G10L 15/30; G10L 13/08; G06F 3/167; G06F 3/048; G06F 17/30684; G06F 17/3074; G06F 17/30755; G06F 17/30864

USPC ..... 704/258, 260, 261, 270, 270.1, 275, 704/277

See application file for complete search history.

(56) References Cited

U.S. PATENT DOCUMENTS

| | | | | |
|---|---|---|---|---|
| 5,873,059 | A * | 2/1999 | Iijima et al. | 704/207 |
| 5,920,840 | A * | 7/1999 | Satyamurti et al. | 704/267 |
| 6,308,156 | B1 * | 10/2001 | Barry et al. | 704/268 |
| 6,671,617 | B2 * | 12/2003 | Odinak et al. | 701/420 |
| 7,454,348 | B1 * | 11/2008 | Kapilow et al. | 704/269 |
| 7,567,896 | B2 * | 7/2009 | Coorman et al. | 704/10 |
| 8,321,222 | B2 * | 11/2012 | Pollet et al. | 704/260 |
| 8,473,297 | B2 * | 6/2013 | Jang et al. | 704/260 |
| 2002/0087224 | A1 * | 7/2002 | Barile | 700/94 |
| 2003/0004711 | A1 * | 1/2003 | Koishida et al. | 704/223 |
| 2003/0171922 | A1 * | 9/2003 | Beerends et al. | 704/233 |
| 2003/0234824 | A1 * | 12/2003 | Litwiller | 345/865 |
| 2005/0182629 | A1 * | 8/2005 | Coorman et al. | 704/266 |
| 2006/0095848 | A1 * | 5/2006 | Naik | 715/716 |
| 2007/0118377 | A1 * | 5/2007 | Badino et al. | 704/260 |

(Continued)

FOREIGN PATENT DOCUMENTS

WO WO 2011/088053 A2 7/2011

*Primary Examiner* — Edgar Guerra-Erazo

(74) *Attorney, Agent, or Firm* — Knobbe, Martens, Olson & Bear, LLP

(57) ABSTRACT

A group of users may be presented with text and a synthesized speech recording of the text. The users can listen to the synthesized speech recording and submit feedback regarding errors or other issues with the synthesized speech. A system of one or more computing devices can analyze the feedback, modify the voice or language rules, and recursively test the modifications. The modifications may be determined through the use of machine learning algorithms or other automated processes.

31 Claims, 6 Drawing Sheets

(56) References Cited

U.S. PATENT DOCUMENTS

| | | | | |
|---|---|---|---|---|
| 2007/0124142 | A1* | 5/2007 | Mukherjee | 704/235 |
| 2007/0156410 | A1* | 7/2007 | Stohr et al. | 704/275 |
| 2008/0129520 | A1* | 6/2008 | Lee | 340/636.1 |
| 2008/0140406 | A1* | 6/2008 | Burazerovic et al. | 704/260 |
| 2009/0254345 | A1* | 10/2009 | Fleizach et al. | 704/260 |
| 2010/0082328 | A1* | 4/2010 | Rogers et al. | 704/8 |
| 2010/0082344 | A1* | 4/2010 | Naik et al. | 704/258 |
| 2011/0161085 | A1* | 6/2011 | Boda et al. | 704/260 |

* cited by examiner

AUTOMATED TEXT TO SPEECH VOICE DEVELOPMENT

BACKGROUND

Text-to-speech (TTS) systems convert raw text into sound using a process sometimes known as speech synthesis. In a typical implementation, a TTS system first preprocesses raw text input by disambiguating homographs, expanding abbreviations and symbols (e.g., numerals) into words, and the like. The preprocessed text input can be converted into a sequence of words or subword units, such as phonemes. The resulting phoneme sequence is then associated with acoustic features of a number small speech recordings, sometimes known as speech units. The phoneme sequence and corresponding acoustic features are used to select and concatenate speech units into an audio representation of the input text.

Different voices may be implemented as sets of speech units and data regarding the association of the speech units with a sequence of words or subword units. Speech units can be created by recording a human while the human is reading a script. The recording can then be segmented into speech units, which can be portions of the recording sized to encompass all or part of words or subword units. In some cases, each speech unit is a diphone encompassing parts of two consecutive phonemes. Different languages may be implemented as sets of linguistic and acoustic rules regarding the association of the language phonemes and their phonetic features to raw text input. During speech synthesis, a TTS system utilizes linguistic rules and other data to select and arrange the speech units in a sequence that, when heard, approximates a human reading of the input text. The linguistic rules as well as their application to actual text input are typically determined and tested by linguists and other knowledgeable people during development of a language or voice used by the TTS system.

BRIEF DESCRIPTION OF DRAWINGS

Throughout the drawings, reference numbers may be reused to indicate correspondence between referenced elements. The drawings are provided to illustrate example embodiments described herein and are not intended to limit the scope of the disclosure.

DETAILED DESCRIPTION

Introduction

Figure 1:
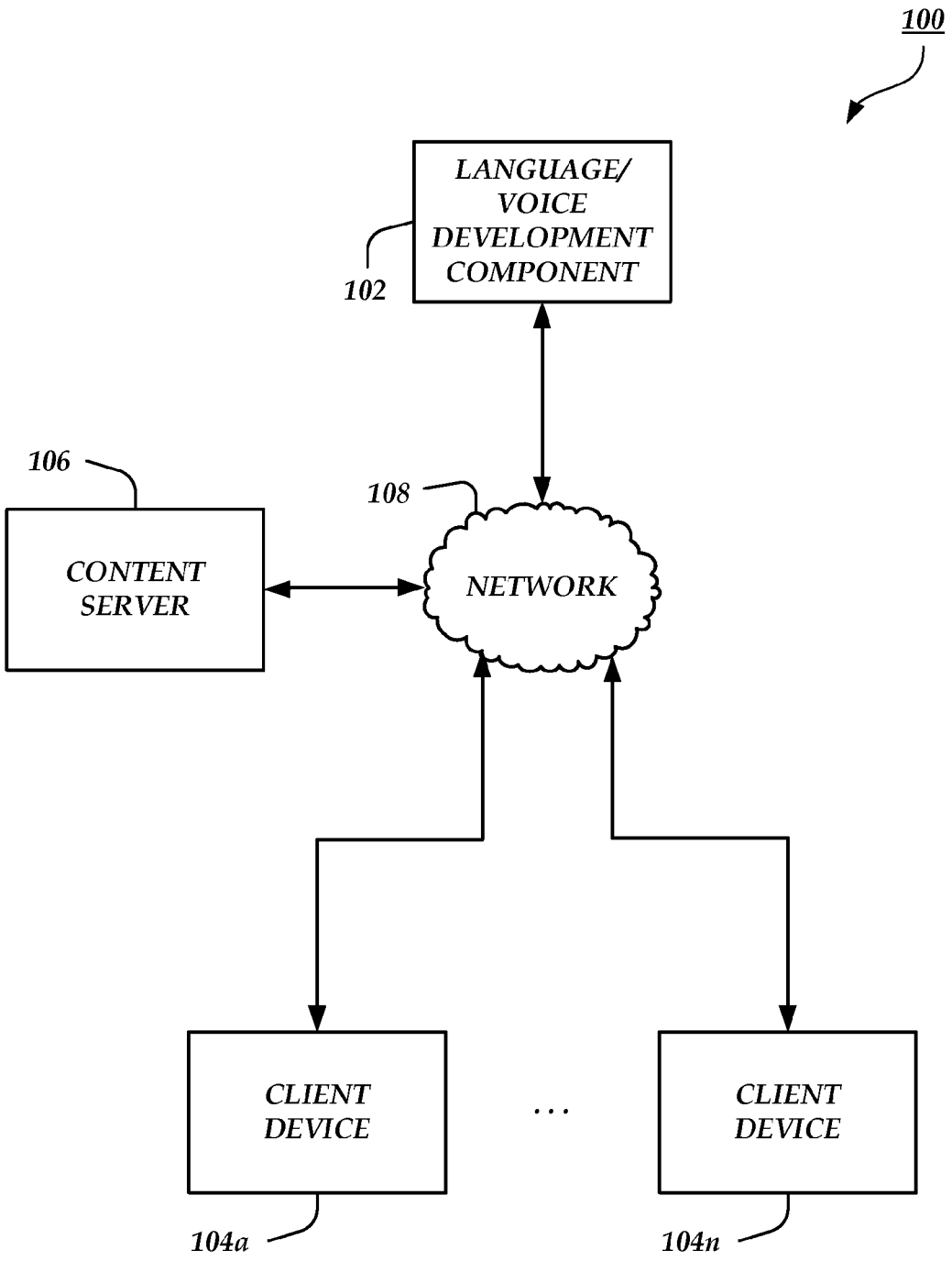
FIG. 1 is a block diagram of an illustrative network computing environment including a language development component, a content server, and multiple client devices.

Generally described, the present disclosure relates to speech synthesis systems. Specifically, the aspects of the disclosure relate to automating development of languages and voices for text to speech (TTS) systems. TTS systems may include an engine that converts textual input into synthesized speech, conversion rules which are used by the engine to determine which sounds correspond to the written words of a language, and voices which allow the engine to speak in a language with a specific voice (e.g., a female voice speaking American English). In some embodiments, a group of users may be presented with text and a synthesized speech recording of the text. The users can listen to the synthesized speech recording and submit feedback regarding errors or other issues with the synthesized speech. A system of one or more computing devices can analyze the feedback, automatically modify the voice or the conversion rules, and recursively test the modifications. The modifications may be determined through the use of machine learning algorithms or other automated processes. In some embodiments, the modifications may be determined through semi-automatic or manual processes in addition to or instead of such automated processes.

Although aspects of the embodiments described in the disclosure will focus, for the purpose of illustration, on interactions between a language development system and client computing devices, one skilled in the art will appreciate that the techniques disclosed herein may be applied to any number of hardware or software processes or applications. Further, although various aspects of the disclosure will be described with regard to illustrative examples and embodiments, one skilled in the art will appreciate that the disclosed embodiments and examples should not be construed as limiting. Various aspects of the disclosure will now be described with regard to certain examples and embodiments, which are intended to illustrate but not limit the disclosure.

With reference to an illustrative embodiment, a speech synthesis system, such as a TTS system for a language, may be created. The TTS system may include a set of audio clips of speech units, such as phonemes, diphones, or other subword parts. Optionally, the speech units may be words or groups of words. The audio clips may be portions of a larger recording made of a person reading a text aloud. In some cases, the audio clips may be modified recordings or they may be computer-generated rather than based on portions of a recording. The audio clips, whether they are voice recordings, modified voice recordings, or computer-generated audio, may be generally referred to as speech segments. The TTS system may also include conversion rules that can be used to select and sequence the speech segments based on the text input. The speech segments, when concatenated and played back, produce an audio representation of the text input.

A language/voice development component can select sample text and process it using the TTS system in order to generate testing data. The testing data may be presented to a group of users for evaluation. Users can listen to the audio representations, compare them to the corresponding written text, and submit feedback. The feedback may include the users' evaluation of the accuracy of the audio representation, any conversion errors or issues, the effectiveness of the audio representation in approximating a recording of a human reading the text, etc. Feedback data may be collected from the users and analyzed using machine learning components and other automated processes to determine, for example, whether there are consistent errors and other issues reported, whether there are discrepancies in the reported feedback, and the like. Users can be notified of feedback discrepancies and requested to reconcile them.

The language/voice development component can determine which modifications to the conversion rules, speech segments, or other aspects of the TTS system may remedy the issues reported by the users or otherwise improve the synthesized speech output. The language/voice development component can recursively synthesize a set of audio representations for test sentences using the modified TTS system components, receive feedback from testing users, and continue to modify the TTS system components for a specific number of iterations or until satisfactory feedback is received.

Leveraging the combined knowledge of the group of users, sometimes known as "crowdsourcing," and the automated processing of machine learning components can reduce the length of time required to develop languages and voices for TTS systems. The combination of such aggregated group analysis and automated processing systems can also reduce or eliminate the need for persons with specialized knowledge of linguistics and speech to test the developed languages and voices or to evaluate feedback from testers.

Network Computing Environment

Prior to describing embodiments of speech synthesis language and voice development processes in detail, an example network computing environment in which these features can be implemented will be described. FIG. 1 illustrates a network computing environment 100 including a language/voice development component 102, multiple client computing devices 104*a*-104*n*, and a content server 106. The various components may communicate via a network 108. In some embodiments, the network computing environment 100 may include additional or fewer components than those illustrated in FIG. 1. For example, the number of client computing devices 104*a*-104*n* may vary substantially, from only a few client computing devices 104*a*-104*n* to many thousands or more. In some embodiments, there may be no separate content server 106.

The network 108 may be a publicly accessible network of linked networks, possibly operated by various distinct parties, such as the Internet. In other embodiments, the network 108 may include a private network, personal area network, local area network, wide area network, cable network, satellite network, etc. or some combination thereof, each with access to and/or from the Internet.

The language/voice development component 102 can be any computing system that is configured to communicate via a network, such as the network 108. For example, the language/voice development component 102 may include a number of server computing devices, desktop computing devices, mainframe computers, and the like. In some embodiments, the language/voice development component 102 can include several devices physically or logically grouped together, such as an application server computing device configured to generate and modify speech syntheses languages, a database server computing device configured to store records, audio files, and other data, and a web server configured to manage interaction with various users of client computing devices 104*a*-104*n* during evaluation of speech synthesis languages. In some embodiments, the language/voice development component 102 can include various modules and components combined on a single device, multiple instances of a single module or component, etc.

The client computing devices 104*a*-104*n* can correspond to a wide variety of computing devices, including personal computing devices, laptop computing devices, hand held computing devices, terminal computing devices, mobile devices (e.g., mobile phones, tablet computing devices, etc.), wireless devices, electronic readers, media players, and various other electronic devices and appliances. The client computing devices 104*a*-104*n* generally include hardware and software components for establishing communications over the communication network 108 and interacting with other network entities to send and receive content and other information. In some embodiments, a client computing device 104 may include a language/voice development component 102.

The content server 108 illustrated in FIG. 1 can correspond to a logical association of one or more computing devices for hosting content and servicing requests for the hosted content over the network 108. For example, the content server 108 can include a web server component corresponding to one or more server computing devices for obtaining and processing requests for content (such as web pages) from the language/voice development component 102 or other devices or service providers. In some embodiments, the content server 106 may be a content delivery network (CDN) service provider, an application service provider, etc.

Language Development Component

Figure 2:
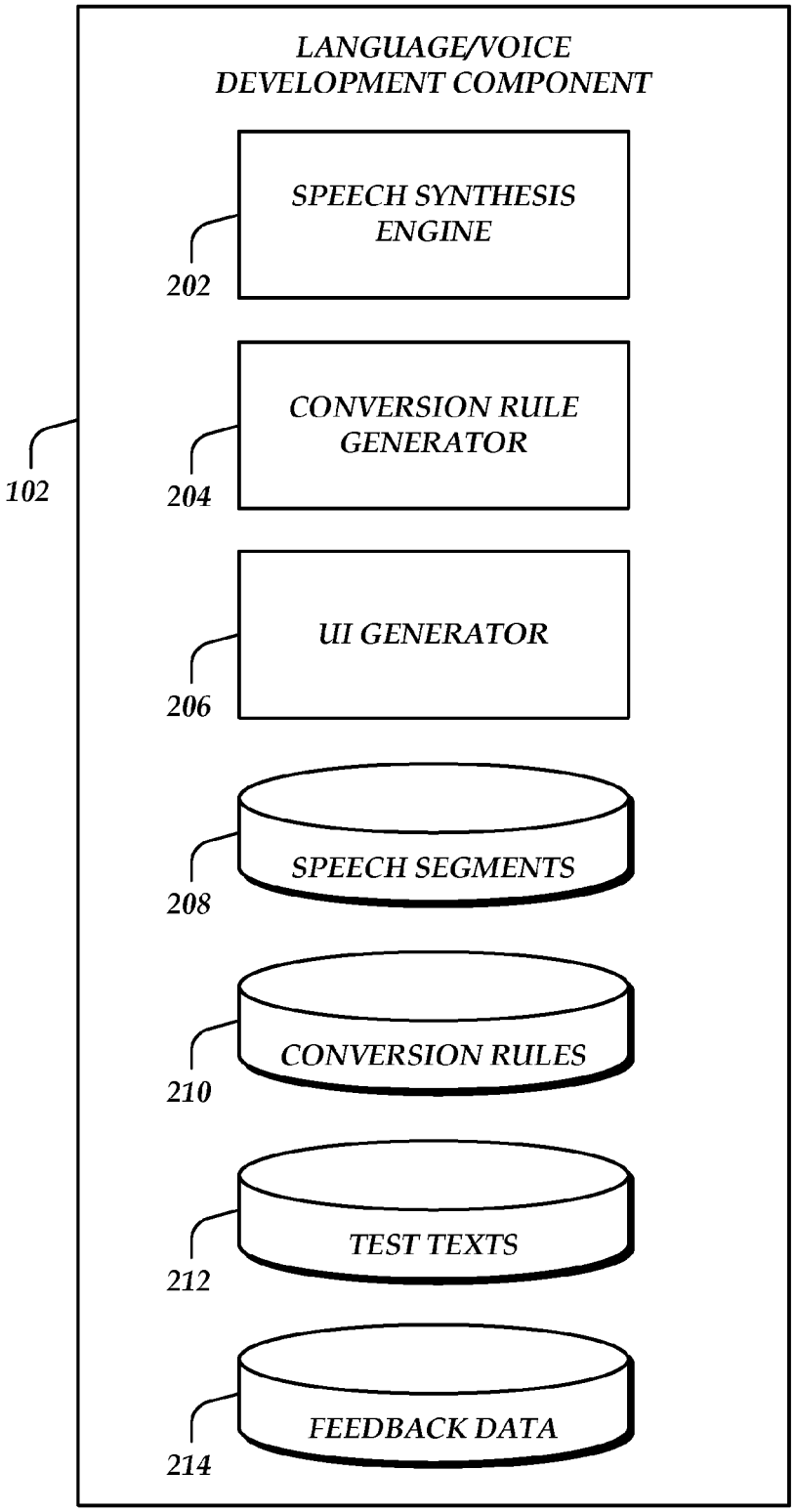
FIG. 2 is a block diagram of an illustrative language development component including a number of modules and storage components.

FIG. 2 illustrates a sample language/voice development component 102. The language/voice development component 102 can be used to develop languages and voices for use with a TTS system. A TTS system may be used to synthesize speech in any number of different languages (e.g., American English, British English, French, etc.), and for a given language, in any number of different voices (e.g., male, female, child, etc.). Each voice can include a set of recorded or synthesized speech units, also referred to as speech segments, and each voice can include a set of conversion rules which determine which sequence of speech segments will create an audio representation of a text input. A series of tests may be created and presented to users, and feedback from the tests can be used to modify the conversion rules and/or speech segments in order to make the audio representations more accurate and the speech segments more natural. The modified conversion rules and speech segments can then be retested a predetermined or dynamically determined number of times or as necessary until desired feedback is received.

The language/voice development component 102 can include a speech synthesis engine 202, a conversion rule generator 204, a user interface (UI) generator 206, a data store of speech segments 208, a data store of conversion rules 210, a data store of test texts 212, and a data store of feedback data 214. The various modules of the language/voice development component 102 may be implemented as two or more separate computing devices, for example as computing devices in communication with each other via a network, such as network 108. In some embodiments, the modules may be implemented as hardware or a combination of hardware and software on a single computing device.

The speech synthesis engine 202 can be used to generate any number of test audio representations for use in evaluating the language or voice. For example, the speech synthesis engine 202 can receive raw text input from any number of different sources, such as a file or records from content sources such as the content server 106, the test texts data store 212, or some other component. The speech synthesis engine 202 can determine which language applies to the text input and then load conversion rules 210 for synthesizing text written in the language. The conversion rules 210 may be used by the speech synthesis engine 202 to select and sequence speech segments from the speech segments data store 208. The conversion rules 210 may specify which subword units correspond to portions of the text, which speech segment best represents each subword unit based on the linguistic or acoustic features and context of the subword unit within the text, etc. In addition, the conversion rules 210 may specify which subword units to use based on any desired accentuation or intonation in an audio representation. For example, interrogative sentences (e.g., those that end in question marks) may be best represented by rising intonation, while affirmative sentences (e.g., those that end in periods) may be best represented by using falling intonation. Speech segments 208 may be concatenated in a sequence based on the conversion rules 210 to create an audio representation of the text input. The output of the speech synthesis engine 202 can be a file or stream of the audio representation of the text input.

The conversion rule generator 204 can include various machine learning modules for analyzing testing feedback data 214 for the language and voice. For example, a number of test audio representations, generated by the speech synthesis generator 202, can be presented to a group of users for testing. Based on the feedback data 214 received from the users, including data regarding errors and other issues, the conversion rule generator 204 can determine which errors and issues to correct. In some embodiments, the conversion rule generator 204 can take steps to automatically correct errors and issues without requiring further human intervention. The conversion rule generator 204 may detect patterns in the feedback data 214, such as a number of users exceeding a threshold have reported a similar error regarding a specific portion of an audio representation. Certain issues may also be prioritized over others, such as prioritizing the correction of homograph disambiguation errors over issues such as an unnatural sounding audio representation. In one example, an error regarding an incorrect homograph pronunciation (e.g., depending on the context, the word "bass" can mean a fish, an instrument, or a low frequency tone, and there are at least two different pronunciations depending on the meaning) has been reported by a number of users, and a portion of the test sentence has been reported as unnatural sounding by a single user. The conversion rule generator 204 can, based on previously configured settings or on machine learning over time, determine that the unnatural sounding portion is a lower priority and should be corroborated before any conversion rule is modified. The conversion rule generator 204 can also automatically generate a new conversion rule regarding the disambiguation of the homograph that may be based on the context (e.g., when "bass" is found within two words of "swim" then use the pronunciation for the type of fish).

The UI generator 206 can be a web server or some other device or component configured to generate user interfaces and present them, or cause their presentation, to one or more users. For example, a web server can host or dynamically create HTML pages and serve them to client devices 104, and a browser application on the client device 104 can process the HTML page and display a user interface. The language/voice development component 102 can utilize the UI generator 206 to present test sentences to users, and to receive feedback from the users regarding the test sentences. The interfaces generated by the UI generator 206 can include interactive controls for displaying the text of one or more test sentences, playing an audio representation of the test sentences, allowing a user to enter feedback regarding the audio representation, and submitting the feedback to the language/voice development component 102.

The data store of conversion rules 210 can be a database or other electronic data store configured to store files, records, or objects representing the conversion rules for various languages and voices. In some embodiments, the conversion rules 210 may be implemented as a software module with computer executable instructions which, alone or in combination with records from a database, implement the conversion rules. The data store of speech segments 208 may be a database or other electronic data store configured to store files, records, or objects which contain the speech segments. In similar fashion, the data store of test texts 212 and the data store of feedback data 214 may be databases or other electronic data stores configured to store files, records, or objects which can be used to, respectively, generate audio representations for testing or to modify the conversion rules and speech segments.

Language Development Process

Figure 3A:
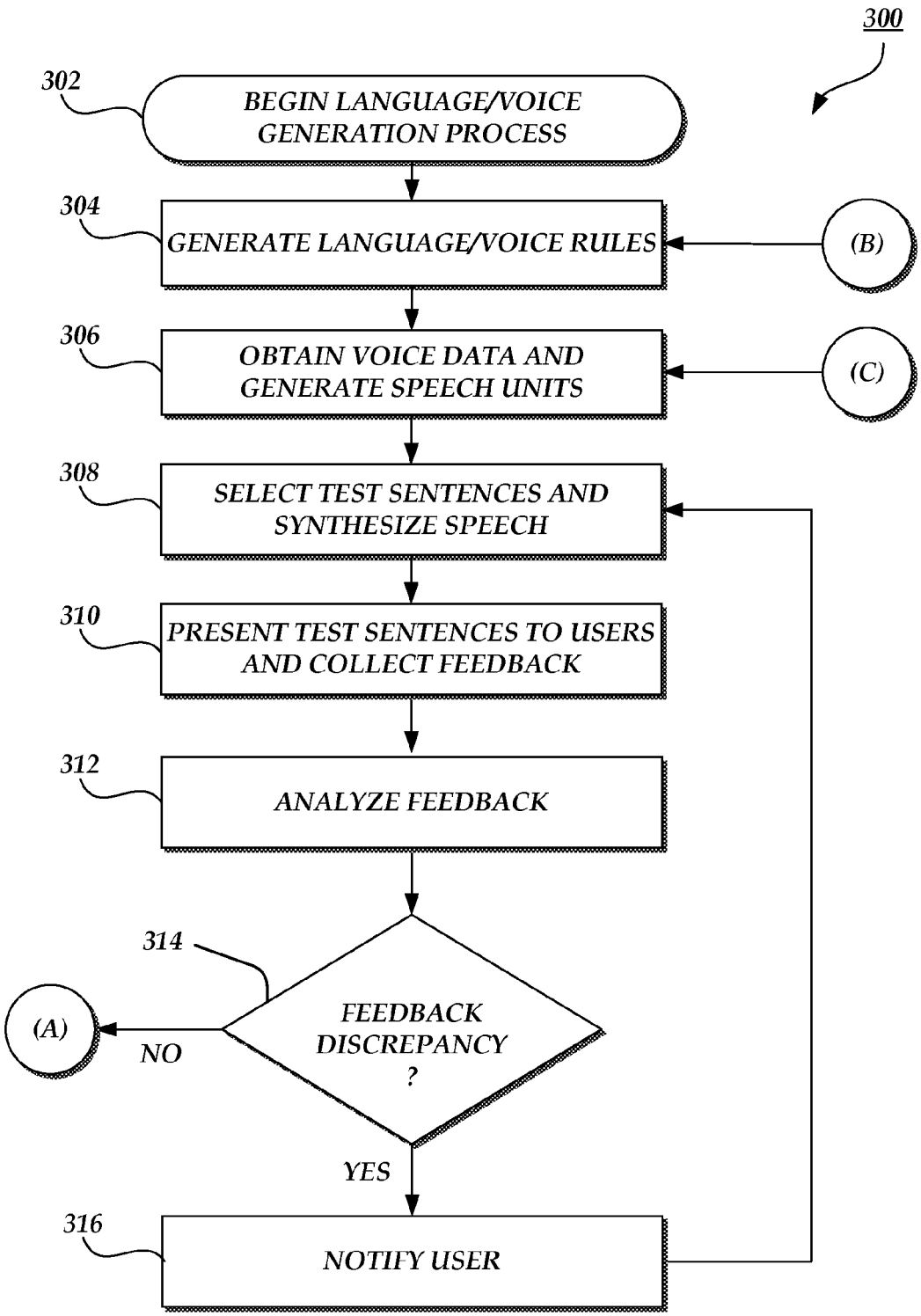
FIGS. 3A and 3B are flow diagrams of an illustrative process for development and evaluation of a voice for a text to speech system.
Figure 3B:
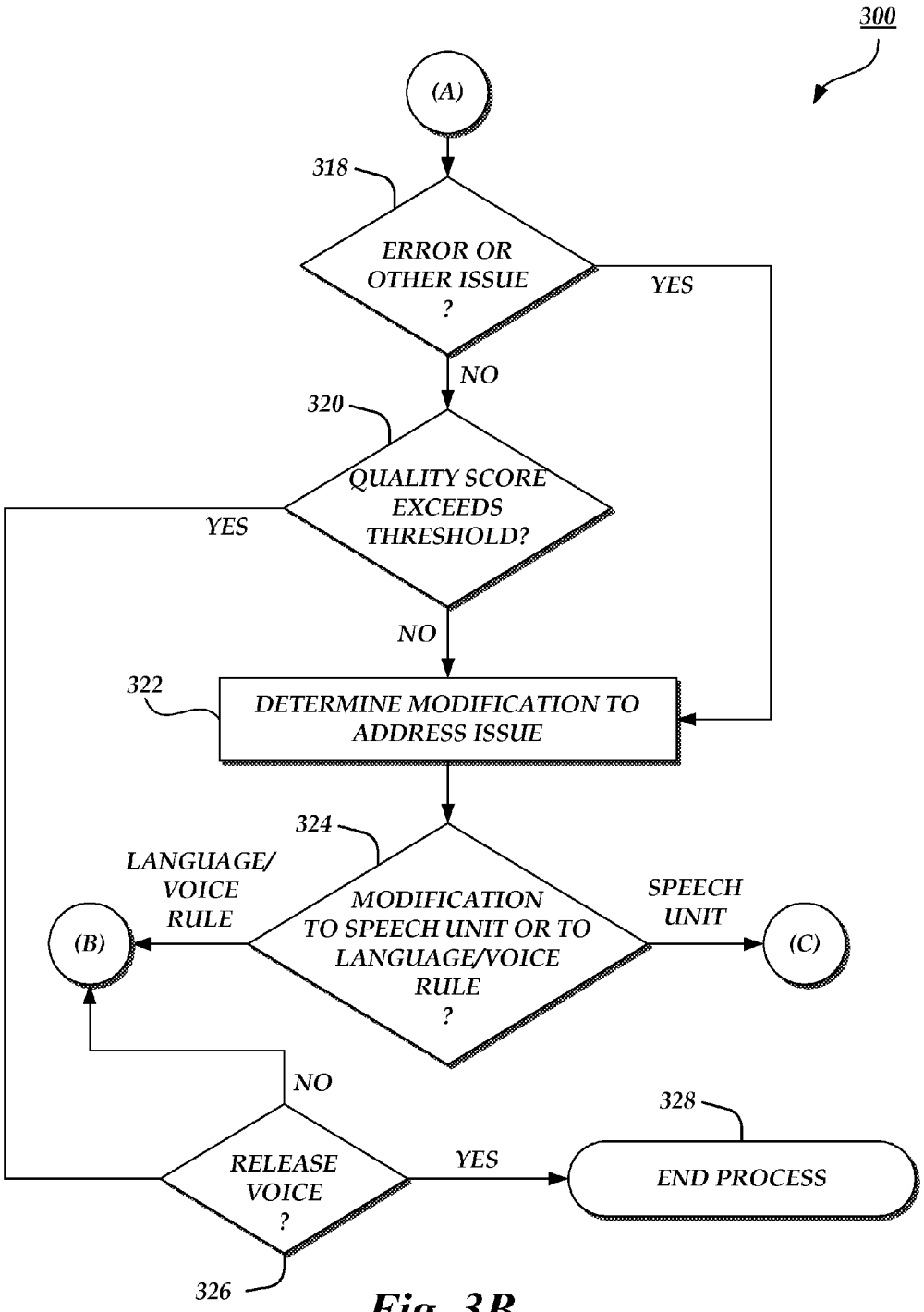

Turning now to FIGS. 3A and 3B, an illustrative process 300 for generating a TTS voice will be described. A TTS system developer may wish to develop a new voice for a previously developed language (e.g., a new male voice for an already released American English product, etc.), or develop an entirely new language (e.g., a new German product will be launched without building on a previously released language and/or voice, etc.). The TTS system developer may record the voice of one or more people, and develop initial conversion rules with input from linguists or other professionals. In some embodiments, the voice may be computer-generated such that no human voice needs to be recorded. Additionally, machine learning algorithms and other automated processes may be used to develop the initial conversion rules such that little or no human linguistic expertise needs to be consulted during development.

The TTS system developer may then utilize any number of testing users to evaluate the output of the TTS system and provide feedback. Advantageously, one or more components of a TTS development system may, based on the feedback, automatically modify the conversion rules or determine that additional voice recordings or other speech segments are desirable in order to address issues raised in the feedback. Moreover, the entire evaluation and modification process may automatically be performed recursively until the conversion rules and speech segments are determined to be satisfactory based on predetermined or dynamically determined criteria.

The process 300 of generating a TTS system voice begins at block 302. The process 300 may be executed by a language/voice development component 102, alone or in conjunction with other components. In some embodiments, the process 300 may be embodied in a set of executable program instructions and stored on a computer-readable medium drive associated with a computing system. When the process 300 is initiated, the executable program instructions can be loaded into memory, such as RAM, and executed by one or more processors of the computing system. In some embodiments, the computing system may encompass multiple computing devices, such as servers, and the process 300 may be executed by multiple servers, serially or in parallel.

At block 304, the language/voice development component 102 can generate conversion rules 210 for a TTS system to use when synthesizing speech. The conversion rules 210 may be used by the speech synthesis engine 202 to select and sequence speech segments from the speech segments data store 208 to produce an audio representation of a text input. The conversion rules 210 may specify which subword units correspond to portions of the text, which speech segment best represents each subword unit based on linguistic or acoustic features or context of the subword unit within the text, etc. Conversion rules 210 may be based on linguistic models and rules, or may be derived from data. For example, the conversion rules 210 may include homograph pronunciation variants based on the context of the homograph, rules for expanding abbreviations and symbols into words, prosody models, data regarding whether a speech unit is voiced or unvoiced, the position of a speech unit or speech segment within a syllable, syllabic stress levels, speech unit length, phrase intonation, etc. In some cases, voice-specific conversion rules may be included, such as rules regarding the accent of a particular voice, rules regarding phrasing and intonation to imitate certain character voices, and the like. The initial conversion rules 210 for a language or voice may be created by linguists or other knowledgeable people, through the use of machine learning algorithms, or some combination thereof.

At block 306, the language/voice development component 102 or some other computing system executing the process 300 can obtain a voice recording of a text, generate speech segments from the voice recording according to the conversion rules and the text, and store the speech segments and data regarding the speech segments in the speech segments data store 208. In a typical implementation, a human may be recorded while reading aloud a predetermined text. Optionally, the voice that is used to read the text may be computer generated. The text can be selected so that one or more instances of each word or subword unit of interest may be recorded for separation into individual speech units. For example, a text may be selected so that several instances of each phoneme of a language may be read and recorded in a number of different contexts. In some embodiments, it may be desirable to use diphones as the recorded speech unit. The actual number of desired diphones (or other subword units, or entire words) may be quite large, and several instances of each diphone, in similar contexts and in a variety of different contexts, may be recorded.

In response to the completion of the recording, the language/voice development component 102 or some other component can generate speech segments from the voice recording. As described above, a speech segments may be based on diphones or some other subword unit, or on words or groups of words. Audio clips of each desired speech unit may be extracted from the voice recording and stored for future use, for example in a data store for speech segments 208. In some embodiments, the speech segments may be stored as individual audio files, or a larger audio file including multiple speech segments may be stored with each speech segments indexed.

At block 308, the language/voice development component 102 can select sentences or other text portions from which to generate synthesized speech for testing and evaluation. The language/voice development component 102 may have access to a repository of text, such as a test texts data store 212. In some embodiments, text may be obtained from an external source, such as a content server 106. The text that is chosen to create synthesized speech for testing and evaluation may be selected according to the intended use of the voice under development, sometimes known as the domain. For example, if the voice is to be used in a TTS system within a book reading application, then text samples may be chosen from that domain, such as popular books or other sources which use similar vocabulary, diction, and the like. In another example, if the voice is to be used in a TTS system with more specialized vocabulary, such as synthesizing speech for technical or medical literature, examples of text from that domain, such as technical or medical literature, may be selected.

Audio representations of the selected test text may be created by the speech synthesis engine 202 of the language/voice development component 102. Synthesis of the speech may proceed in a number of steps. In a sample embodiment, the process includes: (1) preprocessing of the text, including expansion of abbreviations and symbols into words; (2) conversion of the preprocessed text into a sequence of phonemes or other subword units based on word-to-phoneme rules and other conversion rules; (3) association of the phoneme sequence with acoustic, linguistic, and/or prosodic features so that speech segments may be selected; and (4) concatenation of speech segments into a sequence corresponding to the acoustic, linguistic, and/or prosodic features of the phoneme sequence to create an audio representation of the original input text. As will be appreciated by one of skill in the art, any number of different speech synthesis techniques and processes may be used. The sample process described herein is illustrative only and is not meant to be limiting.

Figure 4:
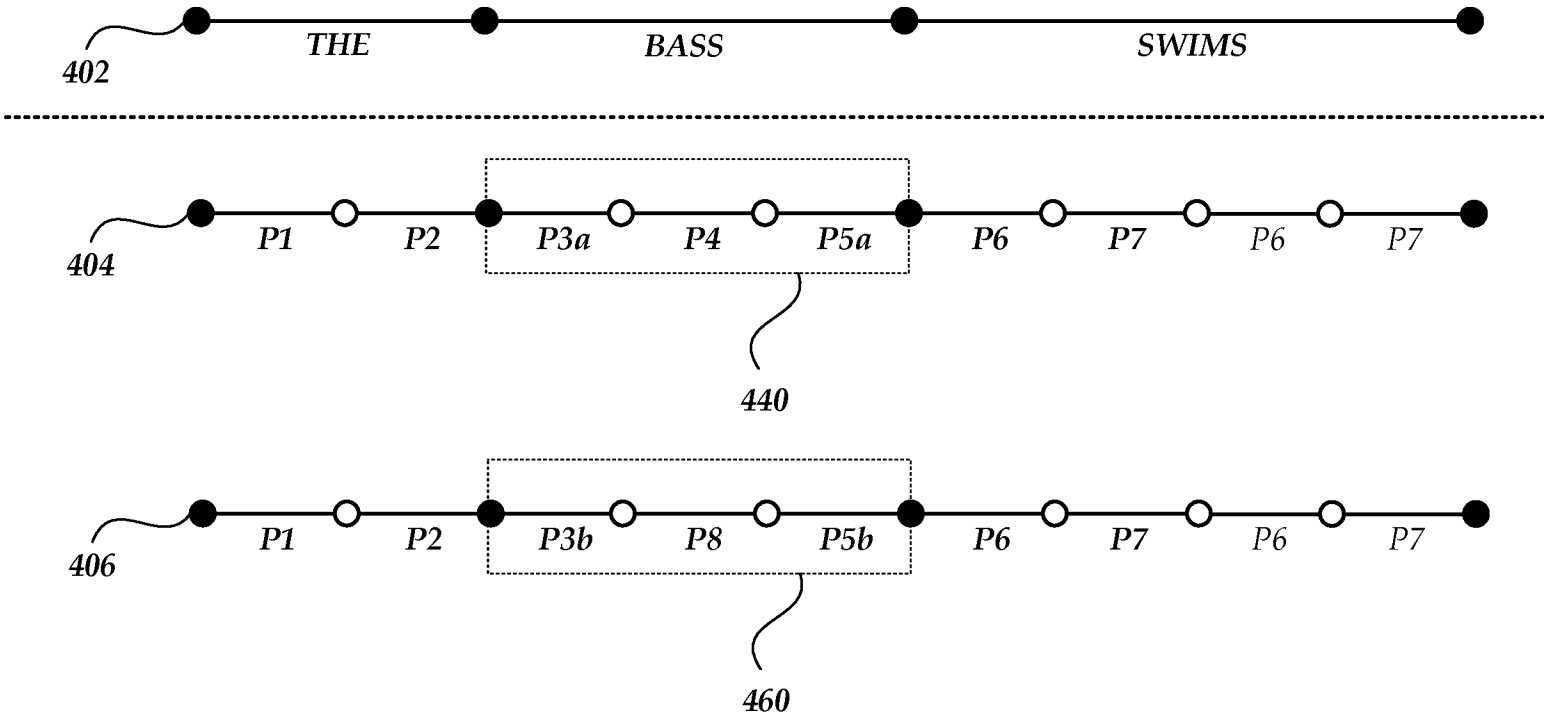
FIG. 4 is a diagram of an illustrative test sentence and two possible phonemic transcriptions of the test sentence.

FIG. 4 illustrates an example test sentence and several potential phoneme sequences which correspond to the test sentence. In some embodiments, a test sentence may not be converted to a phoneme sequence, but instead may be converted to a sequence of other subword units, expanded words, etc. A test sentence 402 including the word sequence "The bass swims" is shown in FIG. 4. Converting the test sentence 402 into a sequence of phonemes word-by-word may result in at least two potential phoneme sequences 404, 406. The first phoneme sequence 404 may include a phoneme sequence which, when used to select recorded speech units to concatenate into an audio representation of the test sentence 402 results in the word "bass" being pronounced as the instrument or tone rather than the fish. The second phoneme sequence 406 includes a slightly different sequence of phonemes, as seen by comparing section 460 to section 440 of the first phoneme sequence 404. The use of phoneme P8 in section 460, rather than phoneme P4 as in section 440, may result in the word "bass" being pronounced as the fish instead of the instrument or tone. Additionally, different versions of the preceding P3 and subsequent P5 phonemes may have been substituted in the second phoneme sequence 406 to account for the different context (e.g.: the different phoneme in between them). The conversion rules 210 may include a rule for disambiguating the homograph "bass" in the test sentence 402, and therefore for choosing the phoneme sequence 404, 406 which more likely includes the correct pronunciation. As initially determined, the conversion rules 210 may be incomplete or erroneous, and the speech synthesis engine 202 may choose the phoneme sequence 404 to use as the basis for speech unit selection, resulting in the incorrect pronunciation of "bass."

As described in detail below, users may listen to the synthesized speech, compare the speech with the written test sentence, and provide feedback that the language/voice development component 102 may use to modify the conversion rules 210 so that the correct pronunciation of "bass" is more likely to be chosen in the future. A similar process may be used for detecting and correcting other types of errors in the conversion rules 210 and speech segments 208. For example, incorrect expansion of an abbreviation or numeral (e.g., pronouncing 57 as "five seven" instead of "fifty seven"), a mispronunciation, etc. may indicate conversion rule 210 issues. Errors and other problems with the speech segments 208 may also be reported. For example, a particular speech segment may, either alone or in combination with other speech segments, cause audio problems such as poor quality playback.

In addition to synthesized speech, one or more recordings of complete sentences, as read by a human, may be included in the set of test sentences and played for the users without indicating to the users which of the sentences are synthesized and which are recordings of completely human-read sentences. By presenting users with actual human-read sentences in addition to synthesized sentences, the language/voice development component 102 may determine a baseline with which to compare user feedback collected during the testing process. For example, users who find a number of errors in a human read sentence that is chosen because it is a correct reading of the text can be flagged and the feedback of such users may be excluded or given less weight, etc. In another example, when a threshold number or portion of users provide similar feedback for the human-read sentences as the synthesized sentences, the TTS developer may determine that the language is ready for release, or that different users should be selected to evaluate the voice.

Returning to FIGS. 3A and 3B, at block 310 the language/voice development component 102 may present the synthesized speech and corresponding test text to users for evaluation. In some embodiments, the text is not presented to the user. For example, reading the text while listening to an audio representation can affect a user's perception of the naturalness of the audio representation. Accordingly, the text may be omitted when testing the naturalness of an audio representation. Users may be selected, either intentionally or randomly, from a pool of users associated with the TTS developer. In some embodiments, users may be intentionally selected or randomly chosen from an external pool of users. In further embodiments, independent users may request to be included in the evaluation process. In still further embodiments, one or more users may be automated systems, such as automated speech recognition systems used to automatically measure the quality of speech synthesis generated using the languages and voices developed by the language/voice development component 102.

The UI generator 206 of the language/voice development component 102 may prepare a user interface which will be used to present the test sentences to the testing users. For example, the UI generator 206 may be a web server, and may serve HTML pages to client devices 104*a*-104*n* of the testing users. The client devices 104*a*-104*n* may have browser applications which process the HTML pages and present interactive interfaces to the testing users.

Figure 5:
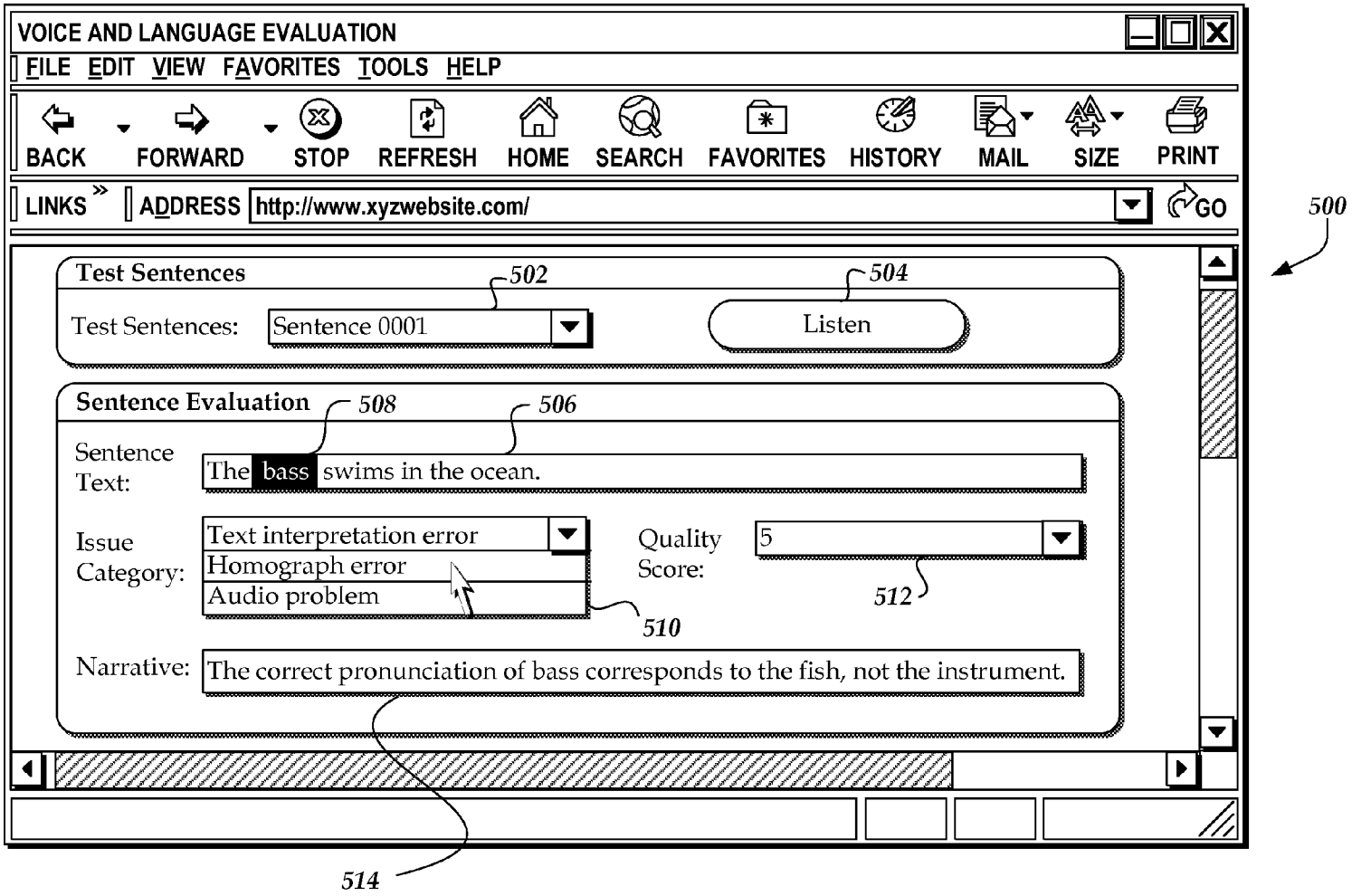
FIG. 5 is a user interface diagram of an illustrative interface for presenting test sentences and audio representations to a user, including several controls for facilitating collection of feedback from users about the test audio representations.

FIG. 5 illustrates a sample UI 500 for presenting test sentences and audio representations thereof to users, and for collecting feedback from the users regarding the audio representations. As illustrated in FIG. 5, a UI 500 may include a sentence selection control 502, a play button 504, a text readout 506, a category selection control 510, a quality score selection control 512, and a narrative field 514. A user may be presented with a set of test sentences to evaluate, such as 10 separate sentences, and each test sentence may correspond to a synthesized audio representation. In addition, one or more of the test sentences may be included which, unknown to the user, correspond to a recording of a completely human-read sentence. The user may select one of the test sentences from the sentence selection control 502, and activate the play button 504 to hear the recording of the synthesized or human-read audio representation. The text corresponding to the synthesized or human-read audio representation may be presented in the text readout 506. If the user determines that there is an error or other issue with the audio representation, the user can highlight 508 the word or words in the text readout 506, and enter feedback regarding the issue. In some embodiments, a user may be provided with different methods for indicating which portions of an audio representation may have an issue. For example, a waveform may be visually presented and the user may select which portion of the waveform may be at issue.

Returning to the previous example, one test sentence may include the words "The bass swims in the ocean." The pronunciation of the word "bass" may correspond to the instrument or tone rather than the fish. From the context of the word "bass" in the test sentence (e.g., followed immediately by the word "swim" and shortly thereafter by the word "ocean"), the user may determine that the correct pronunciation of the word "bass" likely corresponds to the fish rather than the instrument. If the incorrect pronunciation is included in the test audio representation, the user may highlight 508 the word in the text readout 506 and select a category for the error from the category selection control 510. In this example, the user can select the "Homograph error" category. The user may then describe the issue in the narrative field 514. The language/voice development component 102 can receive the feedback data from the users and store the feedback data in the feedback data store 214 or in some other component.

In some embodiments, additional controls may be included in the UI 500. For example, if the user chooses "Homograph error" from the category selection field 510, a new field may be displayed which includes the various options for the correct pronunciation of the highlighted word 508 in the text readout 506, the correct part of speech of the highlighted word 508, etc. A control to indicate the severity of the issue or error may also be added to the UI 500. For example, a range of options may be presented, such as minor, medium, or critical.

The quality score selection control 512 may be used to provide a quality score or metric, such as a naturalness score indicating the overall effectiveness of the audio representation in approximating a human-read sentence. The language/voice development component 102 may use the quality score to compare the user feedback for the synthesized audio representations to the recordings of human-read test sentences. In some embodiments, once the quality score exceeds a threshold, the audio representation of the test sentence may be considered substantially issue-free or ready for release. The threshold may be predetermined or dynamically determined. In some embodiments, the threshold may be based on the quality score that the user or group of users assigned to the recordings of human-read sentences. For example, once the average quality score for synthesized audio representations is greater than 85% of the quality score given to the recordings of human-read sentences, the language or voice may be considered ready for release.

At block 312 of FIG. 3A, the language/voice development component 102 can analyze the feedback received from the users in order to determine whether the voice is ready for release or whether there are errors or other issues which should be corrected. For example, the language/voice development component 102 can utilize machine learning algorithms, such as algorithms based on classification trees, regression trees, decision lists, and the like, to determine which feedback data is associated with significant or correctable errors or other issues. In some embodiments, the same test sentence or sentences are given to a number of different users. The feedback data 214 from the multiple users is analyzed to determine if there are any discrepancies in error and issue reporting. The language/voice development component 102 may attempt to reconcile feedback discrepancies prior to making modifications to the conversion rules or speech segments.

At decision block 314, the language/voice development component 102 determines whether there are any feedback discrepancies. When a feedback discrepancy for a test sentence is detected, the users may be notified at block 316 and requested to or otherwise given the opportunity to listen to the audio representation again and reevaluate any potential error or issue with the audio representation. In such as case, the process 300 may return to block 308 after notifying the user.

If no discrepancy is detected in the feedback data received from the users, the process 300 may proceed to decision block 318 of FIG. 3B. At decision block 318, the language/voice development component 102 determines whether there is an error or other issue which may require modification of conversion rule or speech segment. Returning to the previous example, if several users have submitted feedback regarding the homograph disambiguation error in the audio representation of the word "bass," the process may proceed to block 322. Otherwise, the process 300 proceeds to decision block 320.

If the process 300 arrives at decision block 320, the language/voice development component 102 may have determined that there is no error or other issue which requires a modification to the conversion rules or speech segments in order to accurately synthesize speech for the test sentence or sentences analyzed. Therefore, the language/voice development component 102 may determine whether the overall quality scores indicate that the conversion rules or speech segments associated with the test sentence or sentences are ready for release or otherwise satisfactory, as described above. If the language/voice development component 102 determines that the quality score does not exceed the appropriate threshold, or if it is otherwise determined that additional modifications are desirable, the process 300 can proceed to block 322. Otherwise, the process 300 may proceed to decision block 326, where the language/voice development component 102 can determine whether to release the voice (e.g.: distribute it to customers or otherwise make it available for use), or to continue testing the same features or other features of the language or voice. If additional testing is desired, the process 300 returns to block 304. Otherwise, the process 300 may terminate at block 328. Termination of the process 300 may include generating a notification to users or administrators of the TTS system developer. In some embodiments, the process 300 may automatically return to block 308, where another set of test sentences are selected for evaluation. In additional embodiments, the voice may be released and the testing and evaluation process 300 may continue, returning to block 304 or to block 308.

At block 322, the language/voice development component 102 can determine the type of modification to implement in order to correct the issue or further the goal of raising the quality score above a threshold. In some cases, the language/voice development component 102 may determine that one or more speech segments are to be excluded or replaced. In such cases, the process 300 can return to block 304. For example, multiple users may report an audio problem, such as noise or muffled speech, associated with at least part of one or more words. The affected words need not be from the same test sentence, because the speech segments used to synthesize the audio representations may be selected from a common pool of speech segments, and therefore one speech segment may be used each time a certain word is used, or in several different words whenever the speech segment corresponds to a portion of a word. The language/voice development component 102 can utilize the conversion rules, as they existed when the test audio representations were created, to determine which speech segments were used to synthesize the words identified by the users. If the user feedback indicates an audio problem, the specific speech segment that is the likely cause of the audio problem may be excluded from future use. If the data store for speech segments 208 contains other speech segments corresponding to the same speech unit (e.g.; the same diphone or other subword unit), then one of the other speech segments may be substituted for the excluded speech segment. If there are no speech segments in the speech segment data store 208 that can be used as a substitute for the excluded speech segment, the language/voice development component 102 may issue a notification, for example to a system administrator, that additional recordings are necessary or desirable. The process 300 may proceed from block 304 in order to test the substituted speech segment.

The language/voice development component 102 may instead (or in addition) determine that one or more conversion rules are to be modified. In such a case the process 300 can return to block 306. For example, as described above with respect to FIGS. 4 and 5, one or more users may determine that a word, such as "bass," has been mispronounced within the context of the test sentence. The feedback data can indicate that the mispronunciation is due to an incorrect homograph disambiguation. In some cases, the correct pronunciation may also be indicated in the feedback data. The language/voice development component 102 can modify the existing homograph disambiguation rule for "bass" or create a new rule. The updated conversion rule may reflect that when the word "bass" is found next to the word "swim" and within three words of "ocean," the pronunciation corresponding to the fish should be used. The process 300 may then proceed from block 306 in order to test the updated language rule.

Other examples of feedback regarding issues associated with speech segments and/or conversion rules may include feedback regarding a text expansion issue, such as the number 57 being pronounced as "five seven" instead of "fifty seven." In a further example, feedback may be received regarding improper syllabic stress, such as the second syllable in the word "replicate" being stressed. Other examples include a mispronunciation (e.g.: pronouncing letters which are supposed to be silent), a prosody issue (e.g.: improper intonation), or a discontinuity (e.g.: partial words, long pauses). In these and other cases, a conversion rule may be updated/added/deleted, a speech segment may be modified/added/deleted, or some combination thereof.

Terminology

Depending on the embodiment, certain acts, events, or functions of any of the processes or algorithms described herein can be performed in a different sequence, can be added, merged, or left out all together (e.g., not all described operations or events are necessary for the practice of the algorithm). Moreover, in certain embodiments, operations or events can be performed concurrently, e.g., through multithreaded processing, interrupt processing, or multiple processors or processor cores or on other parallel architectures, rather than sequentially.

The various illustrative logical blocks, modules, routines, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

The steps of a method, process, routine, or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of a non-transitory computer-readable storage medium. An exemplary storage medium can be coupled to the processor such that the processor can read information from, and write information to, the storage medium. In the alternative, the storage medium can be integral to the processor. The processor and the storage medium can reside in an ASIC. The ASIC can reside in a user terminal. In the alternative, the processor and the storage medium can reside as discrete components in a user terminal.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y and Z," unless specifically stated otherwise, is to be understood with the context as used in general to convey that an item, term, etc. may be either X, Y, or Z, or a combination thereof. Thus, such conjunctive language is not generally intended to imply that certain embodiments require at least one of X, at least one of Y and at least one of Z to each be present.

While the above detailed description has shown, described, and pointed out novel features as applied to various embodiments, it can be understood that various omissions, substitutions, and changes in the form and details of the devices or algorithms illustrated can be made without departing from the spirit of the disclosure. As can be recognized, certain embodiments of the inventions described herein can be embodied within a form that does not provide all of the features and benefits set forth herein, as some features can be used or practiced separately from others. The scope of certain inventions disclosed herein is indicated by the appended claims rather than by the foregoing description. All changes which come within the meaning and range of equivalency of the claims are to be embraced within their scope.

What is claimed is:

1. A system comprising:
one or more processors;
a computer-readable memory; and
a module comprising executable instructions stored in the computer-readable memory, the module, when executed by the one or more processors, configured to:
generate an audio representation of a text,
wherein the audio representation comprises a sequence of speech segments selected from a plurality of speech segments,
wherein the selection of the sequence of speech segments is based at least in part on a plurality of conversion rules, and
wherein each speech segment of the sequence of speech segments corresponds to a subword unit of the text;
transmit, to a plurality of client devices, the text and the audio representation;
receive, from a first client device of the plurality of client devices, first feedback data associated with the audio representation;
receive, from a second client device of the plurality of client devices, second feedback data associated with the audio representation; and
use the first feedback data and the second feedback data to modify, at least in part, the plurality of speech segments or the plurality of conversion rules.

2. The system of claim 1, wherein a speech segment of the plurality of speech segments comprises a recording of one of a phoneme, a diphone, or a triphone.

3. The system of claim 1, wherein the plurality of speech segments is modified to exclude a speech segment.

4. The system of claim 1, wherein the module, when executed, is further configured to:
generate a notification to the first client device indicating a difference between the first feedback data and the second feedback data; and
receive, from the first client device, third feedback data, wherein the third feedback data is different from the first feedback data.

5. The system of claim 1, wherein the module, when executed, is further configured to:
transmit, to the plurality of client devices, a control text and a corresponding control recording of a human reading the control text;
receive, from the first client device:
a first quality score of the audio representation; and
a second quality score of the control recording; and
use the first quality score and the second quality score to modify, at least in part, the plurality of speech segments or the plurality of conversion rules.

6. A computer-implemented method comprising:
under control of one or more computing devices configured with specific computer-executable instructions,
generating an audio representation of a text,
wherein the text comprises a word,
wherein the audio representation comprises a sequence of speech segments of a plurality of speech segments, and
wherein selection of the sequence of speech segments is based at least in part on a plurality of conversion rules;
transmitting the audio representation and the text to a first client device and a second client device of a plurality of client devices;
receiving first feedback data from the first client device, the first feedback data relating to the audio representation;
receiving second feedback data from the second client device, the second feedback data relating to the audio representation; and
determining, based at least in part on the first feedback data and the second feedback data, whether to modify at least one of (i) the plurality of speech segments or (ii) the plurality of conversion rules.

7. The computer-implemented method of claim 6, wherein the plurality of conversion rules comprises rules for determining pronunciation, accentuation, or prosody.

8. The computer-implemented method of claim 6, further comprising:
modifying the plurality of speech segments.

9. The computer-implemented method of claim 6, further comprising:
modifying the plurality of conversion rules.

10. The computer-implemented method of claim 8, wherein modifying the plurality of speech segments comprises excluding one of the plurality of speech segments.

11. The computer-implemented method of claim 9, wherein modifying the plurality of conversion rules comprises adding a new conversion rule to the plurality of conversion rules.

12. The computer-implemented method of claim 6, further comprising:

generating a second audio representation of the text comprising a second sequence of speech segments of the plurality of speech segments, the second sequence based at least in part on the plurality of conversion rules; and transmitting the second audio representation and the text to a third client device of the plurality of client devices.

13. The computer-implemented method of claim 12, wherein the third client device comprises one of the first client device or the second client device.

14. The computer-implemented method of claim 6, wherein a speech segment of the plurality of speech segments comprises a recording of one of a phoneme, a diphone, or a triphone.

15. The computer-implemented method of claim 6, wherein the text is selected from a plurality of texts associated with a common characteristic.

16. The computer-implemented method of claim 15, wherein the common characteristic comprises one of a language, vocabulary, or subject matter.

17. The computer-implemented method of claim 6, wherein the first feedback data comprises one of an incorrect homograph disambiguation, a mispronunciation, a prosody issue, a text-expansion issue, a discontinuity, or an inaudibility.

18. The computer-implemented method of claim 6, wherein the determining comprises determining whether the first feedback data is substantially equivalent to the second feedback data.

19. The computer-implemented method of claim 6, further comprising, generating a notification to the first client device comprising an indication of a difference between the first feedback data and the second feedback data.

20. The computer-implemented method of claim 6, further comprising:

transmitting, to the first client device, a control text and a control recording of a human reading the control text;

receiving, from the first client device:

a first quality of the audio representation; and a second quality score of the control recording; and using the first quality score and the second quality score to modify at least one of (i) the plurality of speech segments or (ii) the plurality of conversion rules.

21. A system comprising:

one or more processors;

a computer-readable memory; and a module comprising executable instructions stored in the computer-readable memory, the module, when executed by the one or more processors, configured to:

generate an audio representation of a text, wherein the audio representation comprises a sequence of speech segments of a plurality of speech segments, and wherein the sequence is based at least in part on a plurality of conversion rules;

transmit the audio representation to a first client device and a second client device of a plurality of client devices;

receive first feedback data from the first client device, wherein the first feedback data relates to the audio representation;

receive second feedback data from the second client device, wherein the second feedback data relates to the audio representation; and determine whether to modify at least one of (i) the plurality of conversion rules or (ii) the plurality of speech segments based at least in part on at least one of the first feedback data and the second feedback data.

22. The system of claim 21, wherein the plurality of conversion rules comprises rules for determining pronunciation, accentuation, or prosody.

23. The system of claim 21, wherein a speech segment of the plurality of speech segments comprises a recording of one of a phoneme, a diphone, or a triphone.

24. The system of claim 21, wherein the text is selected from a plurality of texts associated with a common characteristic.

25. The system of claim 24, wherein the common characteristic comprises one of a language, a vocabulary, or a subject matter.

26. The system of claim 21, wherein the text comprises a sequence of words, wherein a portion of the audio representation corresponds to a first word of the sequence of words, and wherein the first feedback data indicates a conversion issue associated with the portion of the audio representation.

27. The system of claim 26, wherein the conversion issue comprises one of the following: an incorrect homograph disambiguation; a mispronunciation; a prosody issue; a text-expansion issue; a discontinuity; or an inaudibility.

28. The system of claim 21, wherein the first feedback data comprises an indication of a quality of the audio representation.

29. The system of claim 21, wherein the module, when executed by the one or more processors, is further configured to:

generate a second audio representation of a second text, wherein the second audio representation comprises a second sequence of speech segments of the plurality of speech segments, and wherein the second sequence is based at least in part on the plurality of conversion rules;

transmit the second audio representation to the first client device;

receive third feedback data from the first client device, wherein the third feedback data relates to the second audio representation; and determine whether to modify at least one of (i) the plurality of conversion rules or (ii) the plurality of speech segments based at least in part on the third feedback data.

30. The system of claim 21, wherein the module, when executed by the one or more processors, is further configured to:

transmit the first audio representation to a third client device of the plurality of client device;

receive third feedback data from the third client device, wherein the third feedback data relates to the first audio representation;

determine whether to modify at least one of (i) the plurality of conversion rules or (ii) the plurality of speech segments based at least in part on the third feedback data.

31. The system of claim 21, wherein the module, when executed, is further configured to:

transmit a control recording comprising a recording of a human reading a control text to the first client device;

receive, from the first client device:

a first quality score of the audio representation; and a second quality score of the control recording; and use the first quality score and the second quality score to modify at least one of (i) the plurality of conversion rules or (ii) the plurality of speech segments.

* * * * *

UNITED STATES PATENT AND TRADEMARK OFFICE

CERTIFICATE OF CORRECTION

PATENT NO. : 9,196,240 B2
APPLICATION NO. : 13/720925
DATED : November 24, 2015
INVENTOR(S) : Michal T. Kaszczuk It is certified that error appears in the above-identified patent and that said Letters Patent is hereby corrected as shown below:

Claims

In column 16 at line 54, In Claim 30, change “client device;” to --client devices;--.

Signed and Sealed this
Seventh Day of June, 2016

Michelle K. Lee

Michelle K. Lee
*Director of the United States Patent and Trademark Office*